US008726851B2

(12) United States Patent
Geelen et al.

(10) Patent No.: US 8,726,851 B2
(45) Date of Patent: May 20, 2014

(54) HEAT EXCHANGER ELEMENT WITH A COMBUSTION CHAMBER FOR A LOW CO AND NOX EMISSION COMBUSTOR

(75) Inventors: Frank Geelen, Venlo (NL); Paul Thijssen, Steyl (NL); Jan Van Peteghem, Groningen (NL)

(73) Assignee: Bekaert Combustion Technology B.V., Assen (NL)

( * ) Notice: Subject to any disclaimer, the term of this patent is extended or adjusted under 35 U.S.C. 154(b) by 1086 days.

(21) Appl. No.: 12/680,001

(22) PCT Filed: Oct. 8, 2008

(86) PCT No.: PCT/EP2008/063463

§ 371 (c)(1),
(2), (4) Date: Mar. 25, 2010

(87) PCT Pub. No.: WO2009/053247

PCT Pub. Date: Apr. 30, 2009

(65) Prior Publication Data

US 2010/0282186 A1 Nov. 11, 2010

(30) Foreign Application Priority Data

Oct. 25, 2007 (EP) ..... 07119275
Aug. 27, 2008 (EP) ..... 08163017

(51) Int. Cl.
*F22B 23/06* (2006.01)

(52) U.S. Cl.
USPC ..... 122/367.1; 122/116; 165/170; 165/185; 431/328

(58) Field of Classification Search
USPC ..... 122/10, 235.13, 44.2, 64, 116, 367.1; 165/168, 169, 170, 185; 431/2, 328, 431/326, 354
See application file for complete search history.

(56) References Cited

U.S. PATENT DOCUMENTS

| | | | | | |
|---|---|---|---|---|---|
| 4,356,794 | A * | 11/1982 | Bouman et al. | ..... | 122/158 |
| 7,281,498 | B2 * | 10/2007 | Besik | ..... | 122/367.3 |
| 7,784,434 | B2 * | 8/2010 | Gelderloos | ..... | 122/367.1 |
| 7,823,544 | B2 * | 11/2010 | Christie | ..... | 122/32 |

FOREIGN PATENT DOCUMENTS

| | | | | |
|---|---|---|---|---|
| BE | 628660 | | 6/1963 | |
| EP | 0373027 | B1 | 6/1990 | |
| EP | 498748 | A1 * | 8/1992 | ..... F23D 14/30 |
| EP | 0498748 | B1 | 8/1992 | |
| EP | 1722172 | A1 | 11/2006 | |
| JP | 2000-283405 | A | 10/2000 | |
| WO | WO 2004/092647 | A1 | 10/2004 | |
| WO | WO 2008/078279 | A2 | 7/2008 | |

* cited by examiner

*Primary Examiner* — Gregory A Wilson
(74) *Attorney, Agent, or Firm* — Foley & Lardner LLP

(57) ABSTRACT

The present invention provides a new heat exchanger element comprising a premix burner with an outward curved or ridged burner surface. The heat exchanger element further comprises a combustion chamber. The combustion chamber is bound on one side by the burner and is further made up of water cooled metal walls which, starting from the burner and in downstream direction, first widen and thereafter narrow down to the width of a customary heat exchanger element. This creates enough space for a proper combustion, avoiding dead angles and recirculation or too early ending of the combustion reaction, thereby reaching low emissions of NOx and CO.

9 Claims, 2 Drawing Sheets

HEAT EXCHANGER ELEMENT WITH A COMBUSTION CHAMBER FOR A LOW CO AND NOX EMISSION COMBUSTOR

TECHNICAL FIELD

The present invention relates to a heat exchanger element comprising a combustion chamber for a heat exchanger for boiler and heating applications. More in particular the present invention relates to a heat exchanger element comprising a combustion chamber and a heavy load premix burner with minimal CO and NOx generation.

BACKGROUND ART

Outward curved or ridged premix burner membranes, e.g. as known from WO 2004/092647 in the name of the applicant, especially the two ridged burner membranes, have proven to be very efficient in high load premix applications. The flame patterns produced by outward curved burner surfaces and ridged burner surfaces are defined by a lateral extending flame front. These burner membranes are designed for heavy load burning generating minimal amounts of CO and NOx. However, when these burners are mounted into a combustion chamber, still higher levels of CO and NOx are reached because of the available combustion volume in the combustion chamber and/or the combustion chamber interior design. High CO-values are created when the flame comes in direct contact with cold surfaces, thereby ending the combustion reaction too early. In a V-shaped combustion room of most state of the art heat exchangers the V-shape flame is burning directly onto the cold walls of the V-shaped combustion room. In such a V-shaped combustion room dead spaces are always created at the top directly besides the burner flame. High NOx values on the other hand are created when flue gasses are overheated, for example by recirculation of hot flue gasses due to irregular shape of the combustion room (dead angles). These constraints therefore hinder compaction of the combustion chamber, in spite of the compaction of the burner membrane.

It would be desirable to have a combustion chamber wherein complete combustion, without creation of undesirable combustion products, is guaranteed in the smallest volume attainable.

DISCLOSURE OF INVENTION

An aspect of the present invention provides a new heat exchanger element comprising a premix burner with an outward curved or ridged burner surface. Preferably, the premix burner is a metallic premix burner, more preferably, the premix burner is a metal fiber premix burner. Preferably the burner surface is shaped according to WO 2004/092647, but similar burner membrane shapes are also possible. The heat exchanger element further comprises a combustion chamber. The combustion chamber is bound on one side by the burner and is further made up of water cooled metal walls which first widen and thereafter narrow down to the width of a customary heat exchanger element. This creates enough space for a proper combustion, thereby reaching low emissions of NOx and CO.

The flame patterns produced by outward curved burner surfaces and ridged burner surfaces are defined by a lateral extending flame front. Preferably, in the first part of the combustion chamber (directly after the burner) the chamber opens up following the shape of the flame. Preferably at the level of the end of the lateral flame front, the chamber narrows, preferably gradually, down to the width of a flue gas draft of a customary heat exchanger element. In this way the lateral flame front and the hot flue gasses are perfectly aligned with the cooled sidewalls without creation of dead angles where recirculation could occur and due to avoiding direct burning of flames onto the water cooled metal walls which results in too early ending of the combustion reaction.

In a preferred embodiment, the combustion chamber has a tulip or drop like section which, more preferably follows the flame pattern and bends the flames equally without abrupt altering of the flames. This smooth transition of the width of the combustion chamber in downstream direction provides a proper combustion due to avoiding dead angles and/or recirculation in the combustion chamber in the smallest volume attainable.

Preferably, the heat exchanger element according to the invention is made of aluminium or an aluminium alloy.

When describing the heat exchanger element of the invention, the terms used are to be construed in accordance with the following definitions, unless a context dictates otherwise:

As used herein, the term "lateral" is to be understood meaning to the side as opposed to "median" which should be understood as in the centre, when looking at the section.

The term "curved" should be understood as bending without angles, the term "ridged" should be understood as comprising at least one projection.

BRIEF DESCRIPTION OF FIGURES IN THE DRAWINGS

REFERENCE NUMBERS

Figure 1:
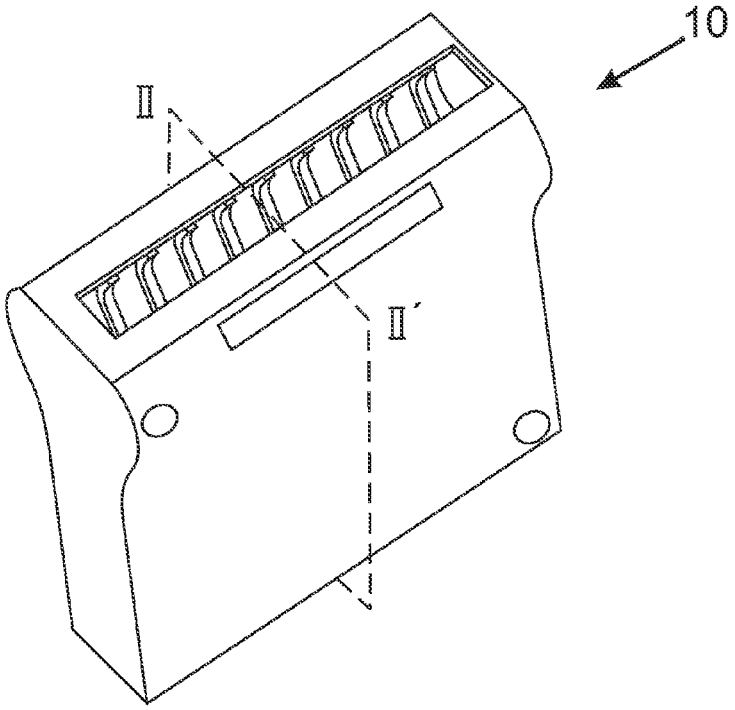
FIG. 1 shows a drawing of an exemplary heat exchanger element according to the present invention.

10 heat exchanger element
12 combustion chamber
14 ridged burner surface
16 water cooled walls
18 long fins
20 flue gas draft
22 pins
24 heat exchange enlarging structure
26 flame front

MODE(S) FOR CARRYING OUT THE INVENTION

Figure 2:
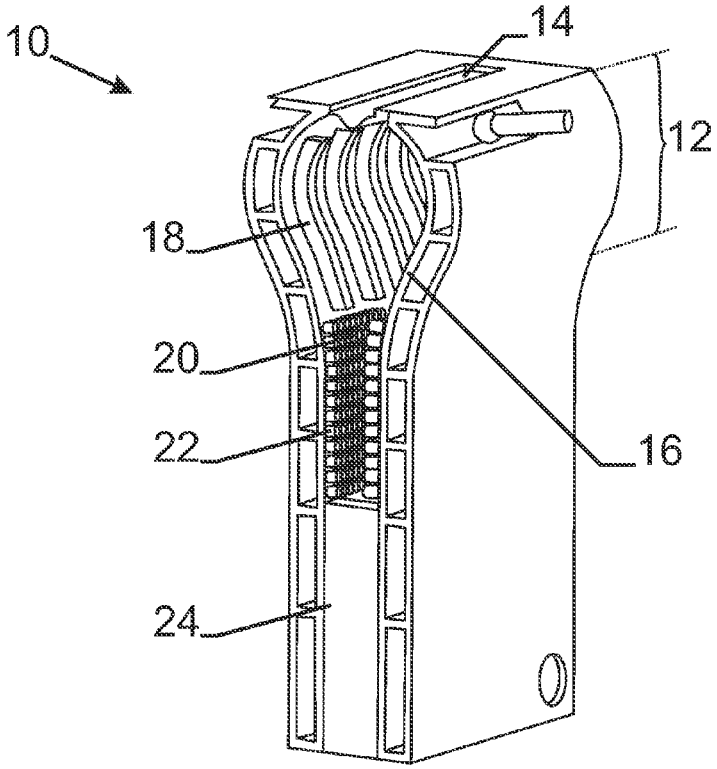
FIG. 2 is a section along the lines II-II' in FIG. 1 wherein a burner is incorporated.
Figure 3A:
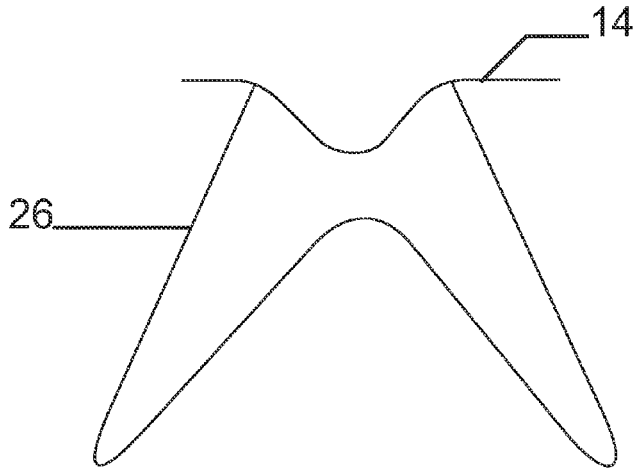
FIG. 3A shows the typical V-shaped flame front of a one-ridged, preferably metal fiber, burner.
Figure 3B:
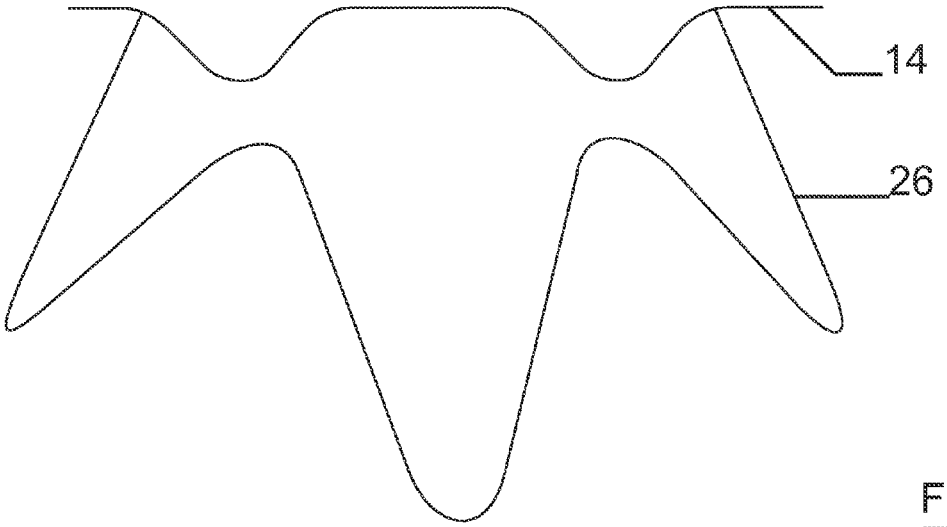
FIG. 3B shows the typical W-shaped flame front of a two-ridged, preferably metal fiber, burner.

FIG. 1 and FIG. 2 show a heat exchanger element 10. The combustion chamber 12 widens downstream from the burner and preferably is designed in a tulip or drop like form. In this exemplary embodiment, the combustion chamber 12 internal design also contains long fins 18 at its inner water cooled walls 16 for removing already a lot of the heat from the flue gases. This tulip form seems particularly useful when using a burner of the type as described in WO 2004/092647. As can be seen on the drawings, the tulip-like form can be described as follows: the burner chamber 12 is bound by the one-ridged burner 14, thereafter the combustion chamber 12 widens and then narrows down to the width of the flue gas draft 20. This specific form is especially designed to follow the lateral flame pattern, exemplary flame patterns are shown in FIG. 3A for a one-ridged burner membrane and in FIG. 3B for a two-ridged burner membrane, and it bends the flames equally without abrupt altering of the flame. This creates enough space for a proper combustion, thereby reaching low emissions of NOx and CO and thereby also attaining a very compact design. NOx levels of <35 mg/kWh and CO-levels of <45 mg/kWh can be achieved by shaping the combustion room in this way.

In a first worked example embodiment as in FIGS. 1 and 2, a one-ridged premix metal fiber burner, the Bekaert Furinit® burner, of 30 kW is burning with a complete combustion and low NOx and CO generation in a combustion chamber of 0.75 l. The specific load of the combustion chamber is 40 kW/l.

Figure 4:
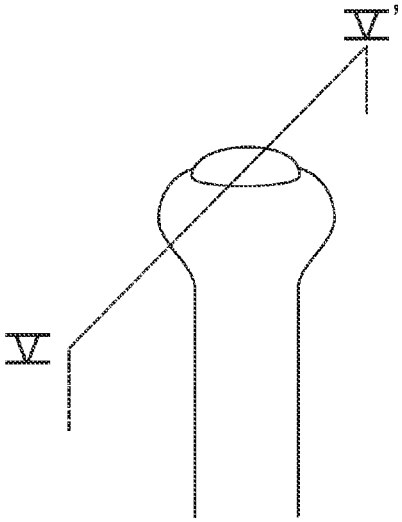
FIG. 4 shows a drawing of another exemplary heat exchanger element according to the present invention.
Figure 5:
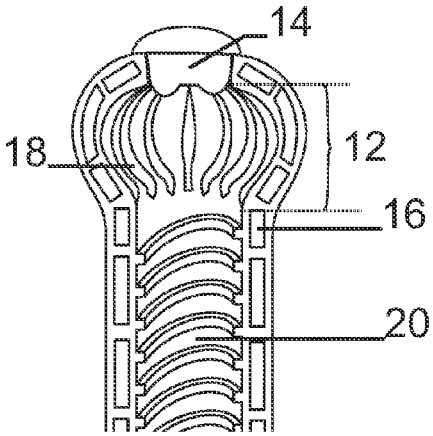
FIG. 5 shows a section along the lines V-V' in FIG. 4.

FIGS. 4 and 5 show another exemplary heat exchanger element with a round section. The premix burner is also a round burner, e.g. known on the market as a Bekaert Furinit® burner, with one round ridge. The heat exchanger element is made up as in FIG. 1 but in a round form, the pins 22 in FIG. 2 are replaced by circular fins in the flue gas draft of FIG. 5. This might be a very useful option in space saving solutions. In this particular embodiment the Furinit® burner has a load of 40 kW in a burner chamber of 1.0 l. The specific load of the combustion chamber is 40 kW/l.

The invention claimed is:

1. A heat exchanger element comprising a premix burner, wherein said burner has an outward curved or ridged burner surface, said heat exchanger element further comprising a combustion chamber being bound by the burner, by water cooled metal walls and by a flue gas draft, said water cooled metal walls first widening from said burner surface in downstream direction and thereafter narrowing down to the flue gas draft in order to avoid direct burning of flames onto the water cooled metal walls.

2. A heat exchanger element according to claim 1, wherein in operation said curved or ridged burner surface creates a flame pattern, said flame pattern having a lateral extending flame front, and wherein said widening of said water cooled metal walls initially follows said lateral extending flame front.

3. A heat exchanger element according to claim 2, wherein said combustion chamber further downstream bends the flames equally without abrupt altering of the lateral flame front.

4. A heat exchanger element as defined in claim 1, said combustion chamber having a tulip or drop shaped section.

5. A heat exchanger element as in claim 1, wherein the heat exchanger element is made of a metal comprising aluminium.

6. A heat exchanger element as in claim 1, wherein said combustion chamber comprises longitudinal fins which follow the internal shape of said combustion chamber.

7. A heat exchanger element as in claim 1, wherein said flue gas draft comprises pinned fins, said pinned fins being elongating in the downstream direction.

8. A condensing gas boiler comprising a heat exchanger element as defined in claim 1.

9. A heat exchanger element as in claim 1, wherein said heat exchanger element is made of aluminum or an aluminum alloy.

* * * * *